United States Patent [19]

Klitzman

[11] 4,042,918

[45] Aug. 16, 1977

[54] APPARATUS INDICATING AN ABSENT GOLF CLUB

[76] Inventor: Charles B. Klitzman, 211 Parker Ave., Deal Park, N.J. 07723

[21] Appl. No.: 683,165

[22] Filed: May 4, 1976

[51] Int. Cl.[2] ..... G08B 13/14; G08B 21/00

[52] U.S. Cl. ..... 340/280; 150/1.5 R; 200/61.41; 273/32 E

[58] Field of Search ..... 340/280; 150/1.5 R, 150/1.5 A, 1.5 B, 1.5 C; 273/32 E; 200/61.41, 61.59

[56] References Cited

U.S. PATENT DOCUMENTS

| | | | |
|---|---|---|---|
| 2,230,173 | 1/1941 | Weir | 200/61.59 |
| 3,273,023 | 9/1966 | Meyer | 36/171 |

*Primary Examiner*—Glen R. Swann, III
*Attorney, Agent, or Firm*—Charles I. Brodsky

[57] ABSTRACT

The described apparatus provides an alarm if a golf club is removed from a bag, and not replaced. The apparatus can be arranged to activate an alarm when a golf club is removed, and to de-activate the alarm when the club is returned. Alternatively, the apparatus can be arranged to condition the alarm when the golf club is removed, and to thereafter activate the alarm if the club is not returned and the bag subsequently moved.

7 Claims, 4 Drawing Figures

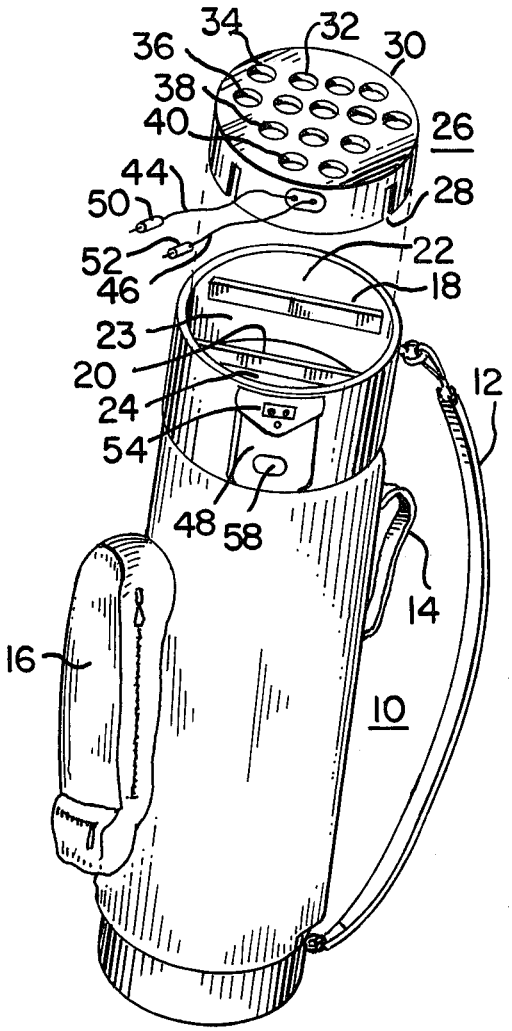
Fig. 1.
Fig. 2.
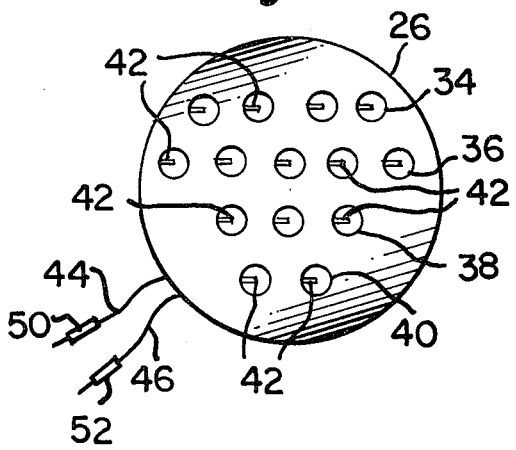
Fig. 3.
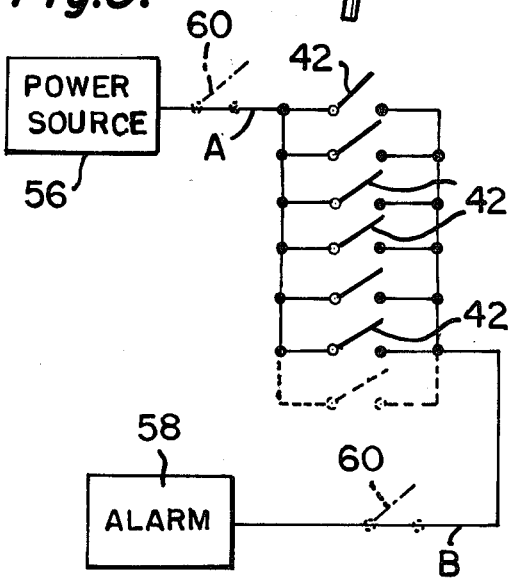
Fig. 4.
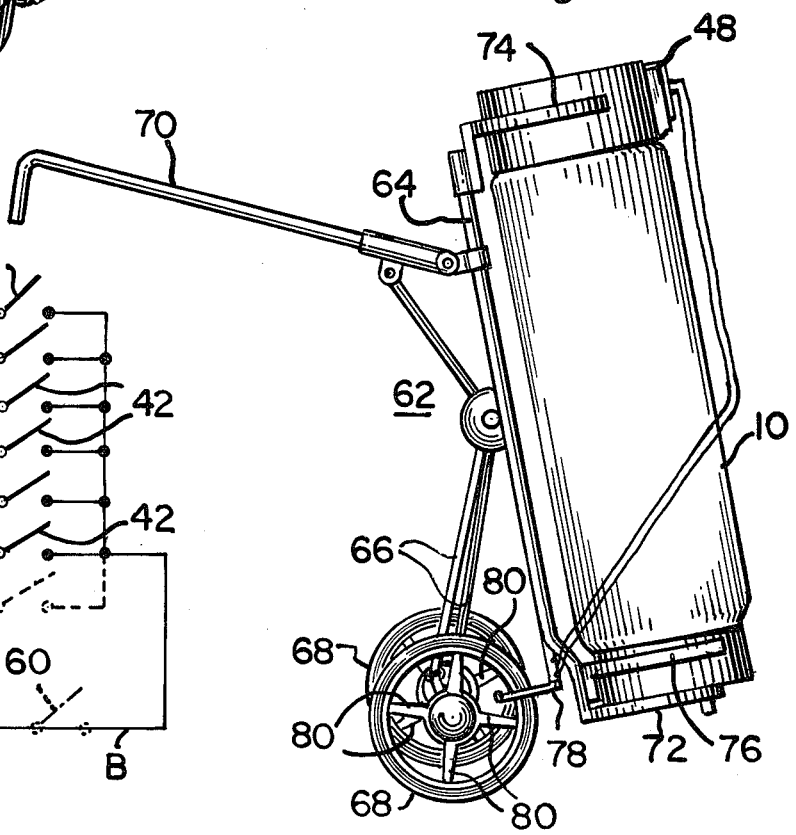

APPARATUS INDICATING AN ABSENT GOLF CLUB

FIELD OF THE INVENTION

This invention relates to golf bags and accessories and, more particularly, to apparatus usable with a golf bag to indicate that a club has been removed from the bag and not replaced.

BACKGROUND OF THE INVENTION

As is well known to those who play it, golf can be a very frustrating game. Although bunkered shots, sidehill lies and missed putts offer extensive frustrations, there is perhaps nothing so frustrating as to lose a golf club during a round. It is not uncommon to see a weekend golfer retracing his play around the course in an attempt to find a club he previously used, but forgot to return to his bag.

For example, it is a practice of many golfers to approach a putting green carrying two clubs in their hands — one club, to chip or pitch the golf ball to the putting surface with, and the second club, to putt towards the hole with. Frequently, the golfer is so elated with making his putt (or, conversely, so disgusted with missing it) that he temporarily forgets to retrieve the first club used, returning to his golf bag only with his putter. Sometimes, his playing partner remembers that the first club has been left lying near the edge of the putting surface, and points this out to him, but most times, the playing partner is too wrapped up in his own game to take notice of what has happened. Later in the round, perhaps at the next hole, perhaps many holes later, the golfer looks for his chipping or pitching iron, as the case may be, and discovers it missing. All too often, he doesn't discover the loss of the club until he is back at the club house, or until he plays at a later date. Also, occasions have arisen where the golfer might return his club to the wrong bag as, for example, where both his bag and that of his playing partner are on the same electric golf cart. In either event, not only is the loss of the golf club frustrating, it can also be costly, as matched golf sets sell for as high as $300.00 and upwards.

SUMMARY OF THE INVENTION

As will become clear hereinafter, the apparatus of the present invention overcomes these problems by providing an indication whenever a golf club is misplaced. In a preferred embodiment, the invention incorporates an adapter for the open end of a golf bag, having within it a plurality of passageways for the reception of golf clubs to be held in an orderly arrangement. Extending into each passageway is the "throw" portion of a single pole, double throw switch, by an amount sufficient to be physically contacted by the thicker, handle end of the golf club shaft. As will be seen, when the golf club shaft is removed from these passageways, the switch is thrown in one direction, whereas the switch is thrown in the other direction when the golf club shaft is inserted into the passageway. Internal to the adapter are a plurality of electrical wirings arranged to couple each switch effectively in parallel, in addition to a pair of electrical wirings extending therefrom to connect with an appropriate alarm — which, for example, may be part of a pocket arrangement on the outside of the golf bag. In one embodiment of the invention, the alarm may include a portable power source and an illuminating bulb, arranged such that if any one golf club is removed from the bag, a switch closure results to illuminate the bulb. In an alternative embodiment, the illuminating bulb may be replaced by an audible alarm, which, too, is activated by the closure of any one switch. In operation, it will be seen that either alarm will remain activated until all clubs have been returned, to break the switch contact In another arrangement of the invention, further apparatus can be provided to only "condition" the alarm upon the removal of the golf club, but which require some additional action before the alarm can be activated. For example, this may take the form of an override control switch, arranged to interact with the spokes of the wheels of a pull-type golf cart, to the extent that only when the golf cart is thereafter moved with the club still not being returned, will the alarm be activated. As will be appreciated, this is especially attractive for the case of the audible alarm system, so as not to permit its sound alarm to interfere with the concentration of the other members of the golfing foursome.

BRIEF DESCRIPTION OF THE DRAWING

These and other features of the present invention will be more clearly understood from a consideration of the following description taken in connection with the accompanying drawing in which:

FIG. 1 illustrates the adapter of the invention for use with a typical golf bag construction;

FIG. 2 is top view of the adapter showing the switch arrangements for operating the alarm;

FIG. 3 is an equivalent electrical circuit diagram helpful in an understanding of the invention; and FIG. 4 shows a pull-type golf cart for providing an audible alarm when the cart is moved without the replacement of the golf club.

DETAILED DESCRIPTION OF THE DRAWING

In FIG. 1, a golf bag 10 is shown as having a pair of handles 12, 14, and one or more storage pockets 16. The golf bag 10 may include one or more supporting ribs, such as 18, 20, which, in addition to adding rigidity, also function to compartmentalize the open end of the bag into a plurality of sections 22–24 to segregate the golf clubs as to type.

In one aspect of the invention, an adapter 26 is provided, which can be seated within the open end of the bag 10, over the sections 18, 20, as by means of keyways 28. (Alternatively, the ribs 18, 20 can be removed, and the adapter 26 form-fitted within the open end of the bag 10, in which case no keyways are required.) The adapter 26 may be comprised of a body section 30 of suitable resilient material, such as foam rubber, polyurethane or any other equivalent substance, having, in general, an external configuration corresponding to that of the golf bag into which it is to be placed. The adaper 26 may be force-fitted to rest within the opening of the bag provided, or may be scewed to it along its outer sides, or may be buckled to it by means of straps and/or clasps (not shown). As indicated, the body section 30 includes a plurality of holes or elongated passageways 32 through which the golf clubs are inserted into the bag. The passageways 32 are generally in parallel alignment with one another and, also, with the vertical axis of the golf bag when the adapter 26 is affixed. If desired, the passageways 32 may be arranged in a predetermined pattern, such that a first line 34 may include four passageways for receiving the woods of a golf set, a second line 36 may include five passageways for accepting the middle irons 2 through 6, a third line 38 may be provided to receive the higher irons 7 through 9 and a fourth row 40 may be provided to receive a putter and wedge. As shown in FIG. 2, a leaf type "throw" 42 of a single pole, double throw spring switch extends into each of these passageways by an amount such that when a golf club is inserted through the passageway and into the bag, the thicker, handle end of the golf club shaft throws the switch to its "open" position and such that when the club is removed via the passageway from the bag, the switch is thrown to its "closed" position. In particular, the handle of a golf club being of a greater diameter than its shaft, it is the handle portion rather than the shaft itself which is positioned with respect to the leaf spring "throw" 42 to make the necessary actuating contact. It will also be understood that with all clubs in the bag, the normal position of all switches will be "open".

As was previously mentioned, the adapter 26 internally includes a plurality of electrical wirings (not shown) arranged to couple each switch effectively in parallel. A pair of electrical wirings 44, 46 extend outwardly from the adapter 26 to connect with appropriate alarm apparatus incorporated, for example, in an adapter pocket 48 which may be clipped to the outside of the golf bag 10. A pair of pin plugs 50, 52 may be provided at the ends of the electrical wirings 44, 46, to connect with appropriate jacks on a power receptacle 54 of the adapter pocket 48. Within the adapter pocket 48 may be a portable power source 56 and an alarm 58 interconnected with each other and with the receptacle so that the equivalent electrical diagram is as illustrated at FIG. 3. As will be readily apparent, the alarm 58 will be activated by means of the power source 56 when any one of the switches 42 are closed, i.e., when one of the golf clubs is removed from the bag. As will also be appreciated, when that club is returned to the bag, its associated switch will be opened and the electrical circuit broken, to extinguish the alarm.

In one embodiment of the invention, the alarm 58 was selected to be an illuminating bulb powered by a battery source. As it is not necessary for the bulb to be continually illuminating, added circuitry can be included to provide the alarm with a "blinking" effect. It will be noted that this intermittent type of alarm will be more easily discernible than one where the bulb is continually lit, especially under the ambient lighting conditions present on a golf course. Whereas this arrangement is particularly suited for the individual golfer, either carrying his bag or pulling it behind him on a golf cart, modifications can easily be made to use this arrangement with an electric golf cart, as where the pin plugs 50, 52 insert into a receptacle on the cart itsef and where the visual alarm is provided at the dashboard. In this case, the alarm can be powered directly from the battery source driving the cart.

The apparatus of the invention may also be modified by substituting an audible alarm for the visual alarm so far discussed. One advantage of such an arrangement is the greater ease with which the audible alarm can be perceived. Another advantage is that the audible alarm can operate with less power than is required by an illuminating bulb to be seen under daylight conditions. One disadvantage of the audible arrangement, however, is that the alarm may be of sufficient volume to be heard by the other members of the golfing foursome, thereby serving as a distraction to their concentrations.

One way of maintaining the advantages of the audible alarm system while eliminating the disadvantage just described is to use an over-ride control switch 60, insertable at points A or B in FIG. 3. Such a switch may also be provided as part of the pocket adapter 48, to remain open until manually switched closed by the golfer after completing the hole, and before moving on to the next tee. If a club has been removed from the golf bag and not properly returned to it, the golfer's closing of this over-ride control switch can provide the audible alert that at least one club has been misplaced. Alternatively, the switch can be provided as an attachment to the wheels of the golf cart, with electrical connections up to the pocket adapter 48 with its power source and alarm, as illustrated in FIG. 4.

There, a golf cart 62 of known construction is shown, comprising a vertical support column 64 to which is connected a wheel brace 66 and associated wheels 68. A handle 70 pivotally connects to the column 64, to the bottom of which is a platform 72 by which the cart 62 can be supported upright when it is not being pulled or pushed. Connected to the upper and lower ends of the column 64 are bracket means 74, 76, which are adapted to detachably receive and hold the golf bag 10 in place. The "throw" 78 of the over-ride control switch 60 is shown adjacent to the spokes 80 of the wheels of the cart 68, such that as the wheels turn, contact is made by the spokes 80 to close the switch. When the cart is not being pulled or pushed, no circuit connection is maintained and the audible alarm will not sound, even if conditioned to be activated by the removal of a golf club from the bag. It will be readily apparent that if the cart is thereafter pulled or pushed while a club is missing, the alarm will sound, and will sound intermittently as the switch is opened or closed by the rotating wheel spokes. In this manner, the alert would not interfere with the concentration of the other golfers of the foresome, as the cart remains stationary during the times that the players are setting up and swinging through their shots, being moved again only after all players have putted out.

While there have been described what are considered to be preferred embodiments of the present invention, it will be readily apparent to those skilled in the art that modifications may be made without departing from the scope of the teachings herein of activating an alarm to indicate that a golf club has been removed from a bag and not replaced. In this manner, the golfer is made aware almost immediately that he has forgotten to return his club, and can quickly and easily retrieve it when its whereabouts are still fresh in his mind. It will also be apparent that the described apparatus may be fabricated as part of an orignal golf bag construction, without requiring additional adapters such as shown by the reference notations 26 and 48, and continue to provide the alert as needed.

It will additionally be apparent that the adapter herein described adds a new dimension to those adapters for golf bags which are presently known in the prior art. By and large, previously known adapters were primarily concerned only with holding clubs in separate compartments and for facilitating their orderly arrangement. Such adapters, in fashion similar to that illustrated in the instant application, utilized apertures to guide the individual golf club into a predetermined alignment, one apart from another, so as to ease the manner by which a club would be inserted and removed from the bag. However, none of these prior configurations have either suggested or disclosed that within individual compartments, control switch arrangements could be inserted to provide indications that a club has been removed, and not replaced.

Furthermore, it will be understood that although an adapter of circular cross section has been illustrated in the drawings, adapters of other configurations may be employed as well, and still follow the teachings herein of providing control switch arrangements to indicate that a golf club has not yet been returned to its bag.

For at least these reasons, therefore, the scope of the present invention should be read in light of the claims appended hereto.

I claim:

1. Apparatus for a golf bag to indicate the absence of a golf club, comprising:

power supply means;

alarm means; and switch means coupling said power supply means and said alarm means in series circuit;

and wherein said switch means includes a body section having a plurality of elongated passageways through which golf clubs are inserted into and removed from said bag and a control switch located within each of said passageways to be actuated to a first condition when a golf club is inserted into said bag and to be actuated to a second condition when a golf club is removed from said bag.

2. The apparatus of claim 1 wherein said control switches are operative to actuate said switch means to an open circuit condition when all golf clubs are inserted into the golf bag, and to actuate said switch means to a closed circuit condition when one or more golf clubs are removed from said bag.

3. The apparatus of claim 2 wherein said alarm means provides a visual indication when said switch means is actuated to a closed circuit condition.

4. The apparatus of claim 2 wherein said alarm means provides an audible indication when said switch means is actuated to a closed circuit condition.

5. The apparatus of claim 2 for use with a golf bag having an open end, wherein said switch means comprises a first adapter configured to seat within said open end to permit the insertion of golf clubs into said bag and the removal of golf clubs therefrom, and wherein said power supply means and alarm means are situated within a second adapter configured to be affixed to an outside section of said golf bag.

6. The apparatus of claim 2 wherein there is also included a control switch in series circuit connection with said switch means and wherein said control switch is actuable to a first or second position, to respectively enable or inhibit said power supply means to activate said alarm when said switch means is in a closed circuit condition.

7. An adapter for holding clubs separate in a golf bag, comprising a plurality of elongated passageways through which golf clubs are inserted into and removed from said bag, and a plurality of control switches individually associated with respective ones of said elongated passageways, and within said passageways, to be actuated to a first switch condition when a golf club is inserted into said bag and to be actuated to a second switch condition when a golf club is removed from said bag.

* * * * *